United States Patent [19]

Wilfong

[11] Patent Number: 4,487,415

[45] Date of Patent: Dec. 11, 1984

[54] BEAD TRANSFERRING PUZZLE

[76] Inventor: Jay F. Wilfong, Rte. 1, Box 387, Newton, N.C. 28658

[21] Appl. No.: 502,221

[22] Filed: Jun. 8, 1983

[51] Int. Cl.[3] ..... A63F 9/08

[52] U.S. Cl. ..... 273/113; 273/153 S

[58] Field of Search ..... 273/153 S, 109, 113, 273/115

[56] References Cited

U.S. PATENT DOCUMENTS 4,376,537 3/1983 Yokoi ..... 273/153 S 4,413,823 11/1983 Breslow ..... 273/153 S

FOREIGN PATENT DOCUMENTS 48795 4/1982 European Pat. Off. ..... 273/153 S

*Primary Examiner*—Anton O. Oechsle

*Attorney, Agent, or Firm*—Charles R. Rhodes; Judith E. Garmon

[57] ABSTRACT

A puzzle comprising a plurality of continuously open, tubular channels which intersect at a common medial point. The channels radiate outwardly from the intersecting medial point, each along a curve having a 360° radius, and have open, distal ends aligned in a common horizontal plane. A plurality of spherical beads are contained in each channel, with each group of spheres being distinguishable from those groups in the other channels. A flat, rotating cap is mounted to rotate in a horizontal plane immediately above the channel openings, said cap having a pair of traps capable of being concentrically aligned with selected ones of the channel openings. When so aligned, the puzzle is manually tilted such that a selected spherical bead is rolled into the trap and, by rotating the cap, the bead can be transferred to another of the channels.

4 Claims, 3 Drawing Figures

BEAD TRANSFERRING PUZZLE

BACKGROUND AND SUMMARY OF THE PRESENT INVENTION

The popularity of puzzles which require intellectual skill and manual dexterity has significantly increased. Examples of such puzzles are found in U.S. Pat. Nos. 3,677,547 and 4,008,895. The present invention is directed to that group including mazes and commonly intersecting passageways through which a spherical member is manipulated.

More specifically the present invention is a puzzle formed of a plurality of continuously open, tubular channels which intersect at a common medial point and which are filled with identifiable groups of spherical beads that are selectively arranged and rearranged for correct solution to the puzzle. The movement of the beads is accomplished by means of a rotating cap that has means for selectively trapping and retaining the spherical members which are tilted thereinto. The open, distal ends of the channels lie in a common horizontal plane on which the rotating cap is mounted.

The cap includes at least two traps having openings which can be selectively aligned with a prescribed channel opening. When so aligned, one of the spherical members is tilted into the trap and transferred to another channel by rotating the cap to align the trap with the opening of another channel and tilting the bead into the channel.

Any number of arrangements and regrouping of the spherical members can be accomplished by the selective transfer from one channel to another. While simple models of the puzzle may include only two channels which intersect at right angles to each other as will be more completely described below, complex puzzles may include as many as six channels intersecting at a common point; or eight, ten, or more channels, only prescribed ones of which intersect at a common medial point but all of which are interrelated for the purpose of trapping and rearranging the beads.

It is thus a primary objective of the present invention to provide a puzzle which requires the exercise of intellectual skill and manual dexterity to solve. It is a further objective to provide such a puzzle in a variety of skill levels. Other and further modifications will become apparent as the following preferred embodiment is studied in conjunction with the following drawings of which:

DETAILED DESCRIPTION OF PREFERRED EMBODIMENT

Figure 1:
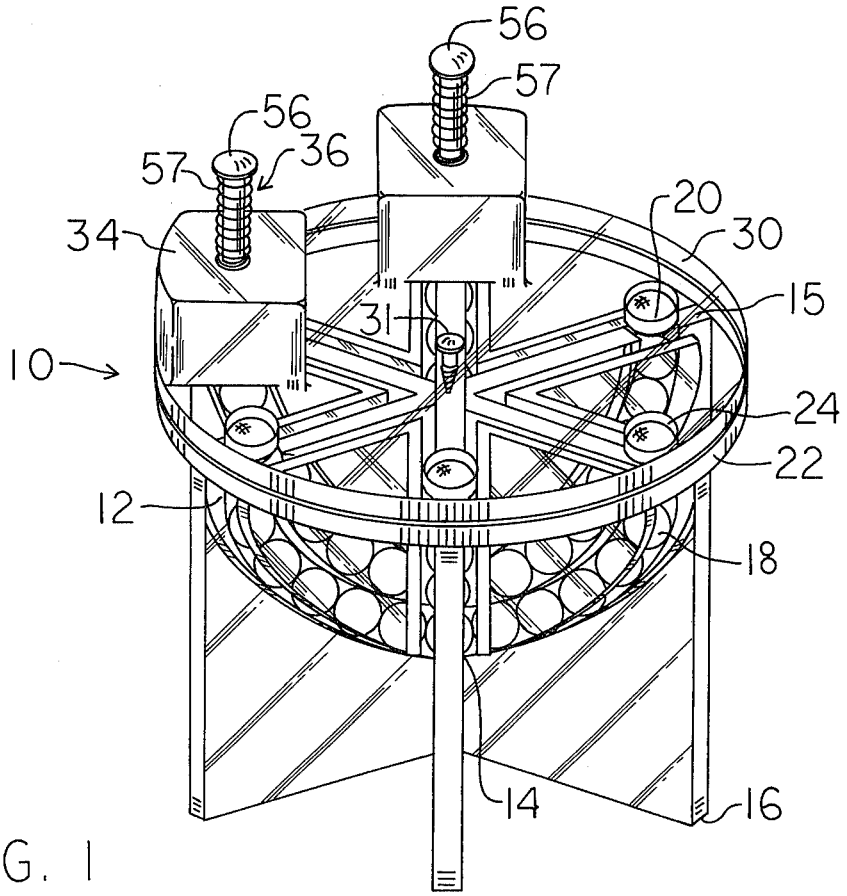
FIG. 1 is a perspective view of a preferred embodiment of the puzzle as designed for intermediate skill level.

Looking first at FIG. 1, the puzzle 10 is shown in a preferred embodiment as designed for an intermediate skill level, having three channels 12 which intersect at a common intersection 14. The channels are open, tubular and continuous, and radiate outwardly from a medial intersection 14, each one along a curve having a radius of 360° . Each channel 12 is filled with spherical members or beads 16 having a diameter slightly less than that of the channel so that the spheres will roll freely in the channels. The puzzle includes a base 16, preferably having a flattened undersurface so that the puzzle will set on a table, etc. Although the channels are shown as curving outwardly from the medial point, it is anticipated that the channels could be straight. Additionally, it is also anticipated that the game could comprise a flat, board surface with intersecting grooves cut therein, whereby the beads are transferred by hand.

The upper surface 15 of the base 16 is a common horizontal plane in which the distal openings 20 to the channels lie. A stationary, flat cover plate 22 is mounted on the surface 15, and includes apertures 24 therethrough which are aligned with channel openings 20. The cover plate 22 provides a smooth, continuous and flat surface on which a rotating cap 30 is concentrically mounted.

The rotating cap 30 includes at least two holes therethrough, which holes act as entryways 32 into closed traps 34 which extend vertically above the cap surface. Although the embodiment shown includes ejector means 36 in each trap, for ejecting the spheres trapped therein, the puzzles may be constructed without such means 36. In such embodiments, the traps would merely have a closed upper surface and the beads would be manually tilted in and out of the traps.

Figure 2:
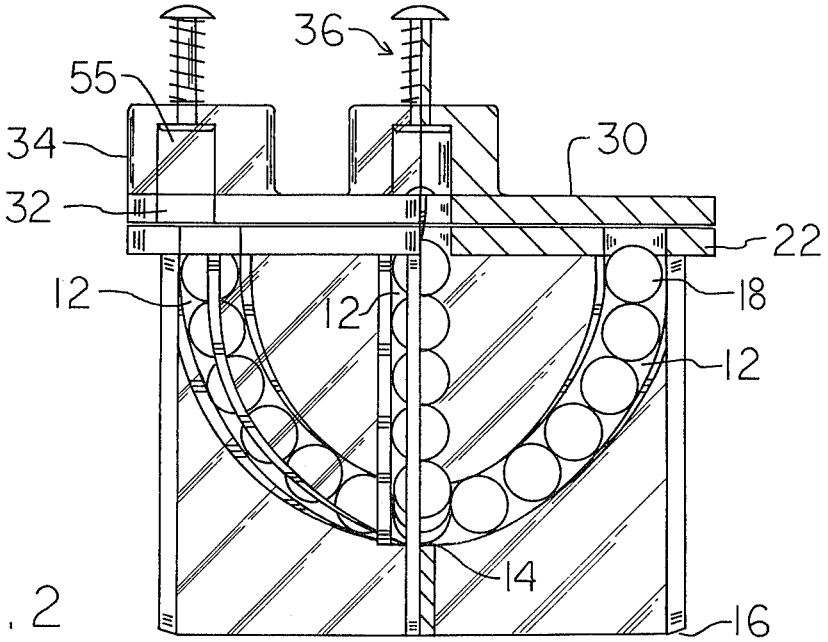
FIG. 2 is a partial cross-sectional view of the puzzle taken along lines 2—2 of FIG. 1.
Figure 3:
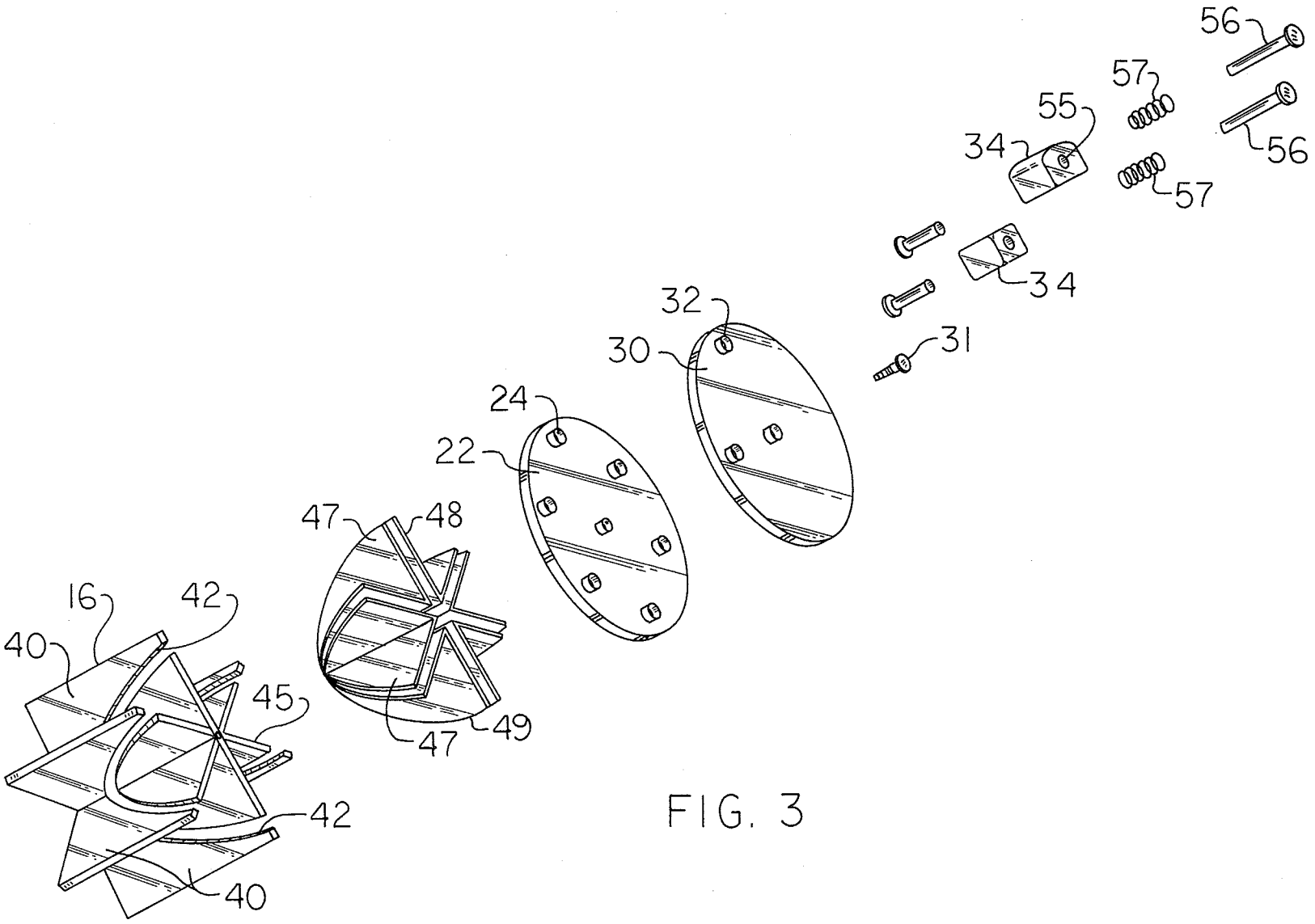
FIG. 3 is an exploded perspective view of the puzzle, illustrating in detail the relationship of the operative parts.

The embodiment shown is constructed of a transparent plastic, injection molded in cooperating segments as shown in FIG. 3. The elements are mounted together to form the channels 12 as best illustrated in FIG. 2. The elements shown in the exploded perspective of FIG. 3 include the base 16 which is molded as one piece comprised of base walls 40 having straight outer edges, and a curved inner edge 42. The six walls 40 are joined to each other, in a side-by-side relationship, at approximate 60° angles in this embodiment. The angle would obviously increase or decrease according to the number of walls. The inner edges 42 are curved, preferably along a radius of 360° , and form one wall of the channels 12 when the spherical element 44 is positioned in the base member. The element 44 comprises six double walled segments 46, joined to each other at approximate 60° angles. Each segment 46 includes horizontally spaced, identical walls 47 having straight upper edges 48 and outer edges 49 curved along a 360° radius. The straight upper edges are joined to the undersurface of cover plate 22, either during the molding process or by glue or heat-setting means during formation of the puzzle.

When element 44 and its attached cover plate 22 are joined by gluing or heat-setting means to the upper edges 17 of the base member, the curved outer edges 49 will be spaced a distance apart from the curved inner edges 42 of the base and complete the formation of channels 12. The spherical element 44 is of an overall diameter which is less than the total diameter of the inner portion of the base member 16. When the two pieces 16 and 44 are joined, the inner edges of walls 40 will lie substantially between, although spaced outwardly from, the walls 47 of the segment 46. Thus, the curved outer edges of one segment 46 and the curved inner edge of the adjacent wall 40 form the tubular channel 12.

The rotating cap 30 is mounted on the cover plate by means of a screw or other such pivotal connector commonly used. The traps 34 are formed by an enclosed vertical passageway or pocket 55. The pocket 55 is of a depth sufficient to receive at least one of the beads 16.

In use, the rotating cap is turned in either direction such that one of the entryways 32 and adjacent traps 34 is aligned with one of the distal channel openings 20. The puzzle is then manually tilted so that a bead will roll into the trap. The cap is then rotated in either direction to carry the trapped bead to the opening of another channel. When the trap is aligned with the opening to the selected channel, the ejector means 36 is used to eject the bead from the trap into the selected channel opening. If the selected channel is full and cannot receive the bead, the cap must be rotated to another position.

The preferred ejector is a pin 56 mounted for sliding movement into and out of the pocket 55. The ejector pin 56 is biased by a spring 57 in a first normal position outside the passageway. To eject a bead, the pin 56 is pushed into the pocket. After the bead is ejected, the pin is released and the spring 57 biases it back into the normal position.

It should be noted that there are two traps 34 on the rotating cap, but only one can be aligned with a channel opening 20 at any given time. The space between the traps 34 is not equal to the space between the channel openings 20. Therefore when one channel opening is aligned with a trap, the other channels remain closed to retain the spheres or beads therein.

Various combinations or arrangements of beads 16 are possible by the repeated trapping and relocating of individual ones of the beads. The beads 16 include means for identifying in groups. For example, the beads in one channel may be red, and those in the other channels of different colors. In some embodiments it is desirable to include a single, separately identifiable bead at the medial intersection 14, which bead is to be retained in that position while all the others are rearranged. This obviously increases the difficulty of the puzzle.

Although it seems rather a simple concept to relocate a group of red beads from one channel to a selected second channel, it must be remembered that the beads in the second channel must be relocated before the red beads can be deposited therein. Therefore, it becomes a challenge to move the two or more groups of beads on a substantially simultaneous basis. A preferred embodiment has been described above but other embodiments and modifications of the puzzle are possible without departing from the scope of the claims below.

What is claimed is:

1. A puzzle apparatus comprising:

(a) a base member including a plurality of continuous, open ended, curved tubular channels intersecting at a common point substantially intermediate the distal ends thereof, each of said channels extending from said intermediate point along an arcuate path to said open, distal end which terminate in a common horizontal plane;

(b) each of said channels containing a plurality of spherical beads having a diameter slightly less than that of said channel such that said beads are freely movable within said channel and introduced thereinto at one of said open distal ends; means for characterizing said beads and differentiating them into a plurality of groups, each of said groups of said beads being contained in a selected one of said channels;

(c) a flat cover plate fixedly and nonrotatably mounted horizontally over said distal end openings of said channels; said cover plate including a plurality of apertures equal in number to, and aligned with, said distal end openings of said channels;

(d) a cap member concentric to and rotatably mounted on said cover plate; said cap having a hole pattern therein comprising at least two spaced holes therethrough, said holes pattern being such that when the cap is rotated, only one of said holes can be moved into alignment with a prescribed one of said channel openings at any given move; and (e) a trap comprising a pocket extending upwardly from each of said holes for receiving and retaining a selected one of said beads therein;

whereby the puzzle is solved by manually tilting the puzzle to roll a selected one of said beads into one of said traps and rotating said cap to transfer the bead which is captured in the trap to another one of said channels, and continuing to make such transfers until all of said beads have been reorganized according to a prescribed pattern or orientation.

2. A puzzle according to claim 1 wherein said tubular channels, said cover plate, and said rotating cap are formed of transparent material.

3. A puzzle according to claim 1 wherein said traps further include a means for ejecting said bead from said trap into one of said channels.

4. A puzzle according to claim 3 wherein said ejection means includes:

(a) a movable ejector pin mounted for selective movement between a first position outside said pocket and a second position in said pocket to push said bead out through said hole aligned with the selected one of said channels; and (b) a spring-biasing means for retaining said ejector pin in said first position outside said pocket.

* * * * *